United States Patent [19]

MacPhee

[11] Patent Number: 4,972,774

[45] Date of Patent: Nov. 27, 1990

[54] AUTOMATICALLY CONTROLLING WATER FEEDRATE ON A LITHOGRAPHIC PRESS

[75] Inventor: John MacPhee, Rowayton, Conn.

[73] Assignee: Baldwin Technology Corporation, Stamford, Conn.

[21] Appl. No.: 728,171

[22] Filed: Apr. 29, 1985

[51] Int. Cl.[5] ..... B41F 7/26; B41F 31/00

[52] U.S. Cl. ..... 101/450.1; 101/148; 101/487; 101/DIG. 45

[58] Field of Search ..... 101/148, 350, 363, 365, 101/DIG. 24, DIG. 26, 450.1, 487, DIG.45

[56] References Cited

U.S. PATENT DOCUMENTS

| | | | |
|---|---|---|---|
| 3,557,817 | 1/1971 | Royse | 101/148 |
| 4,151,796 | 5/1979 | Uhrig | 101/350 X |
| 4,156,388 | 5/1979 | Mabrouk et al. | 101/350 |
| 4,480,542 | 11/1984 | Jeschke | 101/148 |
| 4,485,737 | 12/1984 | Jeschke | 101/148 |

OTHER PUBLICATIONS

Research Progress Report No. 113, "Control of Ink-Water Balance", Graphics Arts Foundation, 1981, Pittsburgh, Pa.

*Primary Examiner*—J. Reed Fisher

*Attorney, Agent, or Firm*—Morgan & Finnegan

[57] ABSTRACT

The invention relates to a method for automatically controlling the water feedrate on a lithographic press which includes a blanket cylinder, a plate cylinder, inking rollers and dampening rollers. The temperature of the fountain solution is regulated so as to be constant. The alcohol concentration is regulated so as to be constant. The ink film thickness on one of the inking rollers is sensed to provide a signal proportional to that variable. The sensing of the ink film thickness on the inking roller is used to determine the water feedrate to the plate cylinder and the rate of water feed is dependent upon the ink film thickness.

4 Claims, 7 Drawing Sheets

AUTOMATICALLY CONTROLLING WATER FEEDRATE ON A LITHOGRAPHIC PRESS

FIELD OF INVENTION

This invention relates to a new and improved method for automatically controlling the water feedrate to the plate cylinder of a lithographic printing press.

BACKGROUND OF INVENTION

In the operation of a lithographic printing press water and printing ink are fed to the printing plate cylinder. Generally speaking, the amount of ink which is fed to the printing plate is a function of the density of ink desired on the printed form. Thus, if a high ink density is required, a greater amount of ink will be fed to the plate than if a lower ink density is desired on the printed form. The problem has been determining the proper amount of water to be fed to the printing plate.

This problem is two-fold First, there is the problem of determining the steady state water feedrate required for a given set-up or job. Second, there is the problem of determining the transient water feedrate required when printing is resumed following a halt after a job has been started.

In recent years the problem of determining the steady state water feedrate has become more acute since the industry has developed means for presetting the ink feed which has helped eliminate the waste of time and paper during the make ready stage. These developments have eliminated the earlier trial and error procedure for ink feed. However, the trial and error procedures have continued for determining the steadystate water feedrate.

Figure 1:
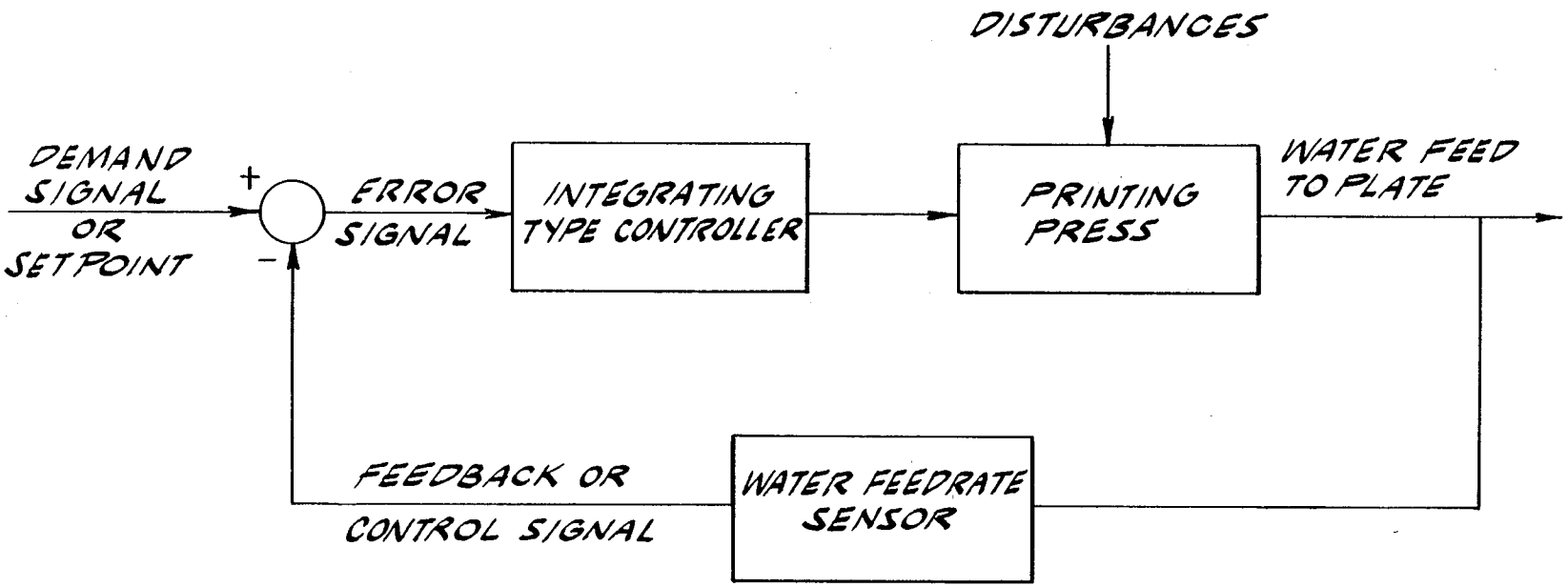
FIG. 1 is a block diagram illustrating general approach used in prior art systems designed to control water feedrate in lithographic printing process.

Referring to FIG. 1, there is shown a block diagram which can be used for illustrative purposes in describing the prior art practices. Referring to FIG. 1, the lithographic printing press is shown by a single block diagram in which the only output of interest is the water feed to the plate. The printing press is subject to various random disturbances causing the water feed output to vary in a random fashion which causes undesirable variations in print quality. As can be seen in the FIG. 1, the prior art water feedrate control systems utilize the feedback or closed loop principle to achieve a constant water feedrate to the plate cylinder.

As shown in FIG. 1, this is accomplished by providing some method of sensing water feedrate and thereby providing a feedback or control signal which is proportional to water feedrate. This is compared to or summed with a demand signal or setpoint to generate an error signal. Thus when the output satisfies the demand or setpoint, the error will be zero. When deviations in output occur these will result in deviations in the error signal, opposite in sign. For example, if water feedrate increases slightly due to some disturbance, a negative error signal will result. This negative error signal is fed to an integrating type controller which will in turn automatically cause the dampening system in the press to produce a corrective action, i.e. to reduce water feedrate. The difficulty with such a system is that it is not known what the demand signal should be in the first place. The demand is unknown and is not constant. A second difficulty with prior systems is that means for sensing water film thickness have not been reliable under pressroom conditions.

The prior art water feedrate systems differ from one another primarily in the method used to sense water feedrate. In short, there are two main methods for controlling the dampening process (water feedrate) in an offset press. The first method is to measure the amount of water on the rollers or the plate to determine the variations in dampening. The second method is to measure certain print variables such as the densities of the solid and tone areas. In other words, the prior art methods involve measuring the water feedrate on the press or measuring the effects of the water feedrate on the printed form An example of the first method is shown and described in U.S. Pat. No. 3,412,677. This patent describes an automatic control system in which the water film thickness is measured on a roller in the dampening system and used to generate a signal for regulating the water feedrate. Another example of this general approach is shown in U.S. Pat. No. 3,960,077 which shows and describes a system which measures the water film thickness on the plate cylinder itself and uses this information to generate a signal for regulating the water feedrate to the plate.

The second approach is described generally in Research Progress Report Number 113 published by the Graphic Arts Technology Foundation (GATF) in 1981. In this prior art practice a process is described wherein a special test target is included in an unusused area of the printed form This process requires the operator to observe the quality of the printed test target area and make adjustments to the ink and water feedrates based on the observations made. According to this process, the operator is instructed that the optimum water feedrate produces neither white spots (snowflakes) in solid printed areas nor whiskers or grains along the edges of solid printed areas The operator is instructed to decrease the water feedrate if snowflakes occur and to increase the water feedrate in the event of whiskering. In addition, the water feedrate must be increased if the ink feedrate increases and to decrease the water feedrate if the ink feedrate decreases.

The difficulty and problem with known prior art systems is that the demand for water, i.e. the set point which determines the demand signal (FIG. 1) must be established and adjusted in each instance by the pressman. This limitation is significant for two reasons.

First, the prior art methods do not provide a means that compensates for or gives a setting for water feedrate when a new job is put on the press. The prior art does not teach, or at best, is uncertain as to the relationship between optimal dampening system adjustments and various other print parameters. For example, certain prior art practices teach that for a given printing job the water feedrate must be increased if the ink feedrate is increased. Similarly, if the ink feedrate is decreased, the water feedrate is to be decreased. In addition, some prior art suggests that the water feedrate should be higher where uncoated paper is used rather than coated paper because the uncoated paper is thought to be more absorbent. The prior art is divided as to what effect the ink coverage on the printed form has on the water feedrate. Thus some prior art teachings suggest that light ink coverage forms required more water while other prior art suggests heavy ink coverage requires more water Where alcohol is used in the fountain solution, most prior art suggests that less water can be used In any event, the current state of the art is such that the optimal steady state water feedrate cannot be predetermined or preset but instead must be determined by a trial and error process during the preliminary make ready process. Moreover, there is confusion in the prior art as to what effect the several variables have on the optimum water feedrate.

A second limitation of the prior art is that a manual setpoint for the water feedrate precludes the flexibility to cope with the large transient demand for water during the printing press start up. It is well known from experience that the water feedrate must be momentarily increased immediately before placing the ink form rollers in the impression position with the plate cylinder. In the usual practice, the pressman satisfies the need for increased water at press startup by using a dampened cloth or a water filled squirt bottle (in the case of web presses) to increase the water feed to the plate cylinder at this time of need. However, the prior art does not teach how much the feedrate must be momentarily increased during the startup. This, of course is another drawback of the prior art systems.

With the foregoing in mind, it is an object of this invention to provide a new and improved means for automatically controlling the dampening water feedrate.

Another object of this invention is to provide a new and improved process for automatically controlling the water feedrate.

A still further object of this invention is to provide a system which automatically controls the water feedrate.

A still further object of this invention is to provide a process for determining the optimum water feed by using the ink film thickness on an inking roller to determine the water feedrate.

Another object of this invention is to sense the thickness of the ink on an inking roller to determine the water feedrate.

A still further object of this invention is to automatically determine and vary the water feedrate in relation to the ink film thickness on an inking roller Another object of this invention is to maintain the fountain solution temperature, the alcohol concentration, and the dampening systems variables constant so that the water feedrate can be determined in relation to the ink thickness on an inking roller.

A still further object of this invention is to provide a process where there is a momentary increase in the water feedrate during startup by programming the demand signal for the water feedrate to the ink film thickness on an inking roller Additional objects and advantages of the invention will be set forth in the description which follows and, in part, will be obvious from the description the objects and advantages being realized and attained by means of the instrumentation, parts, apparatus, steps and procedures particularly pointed out in the appended claims.

Figure 2:
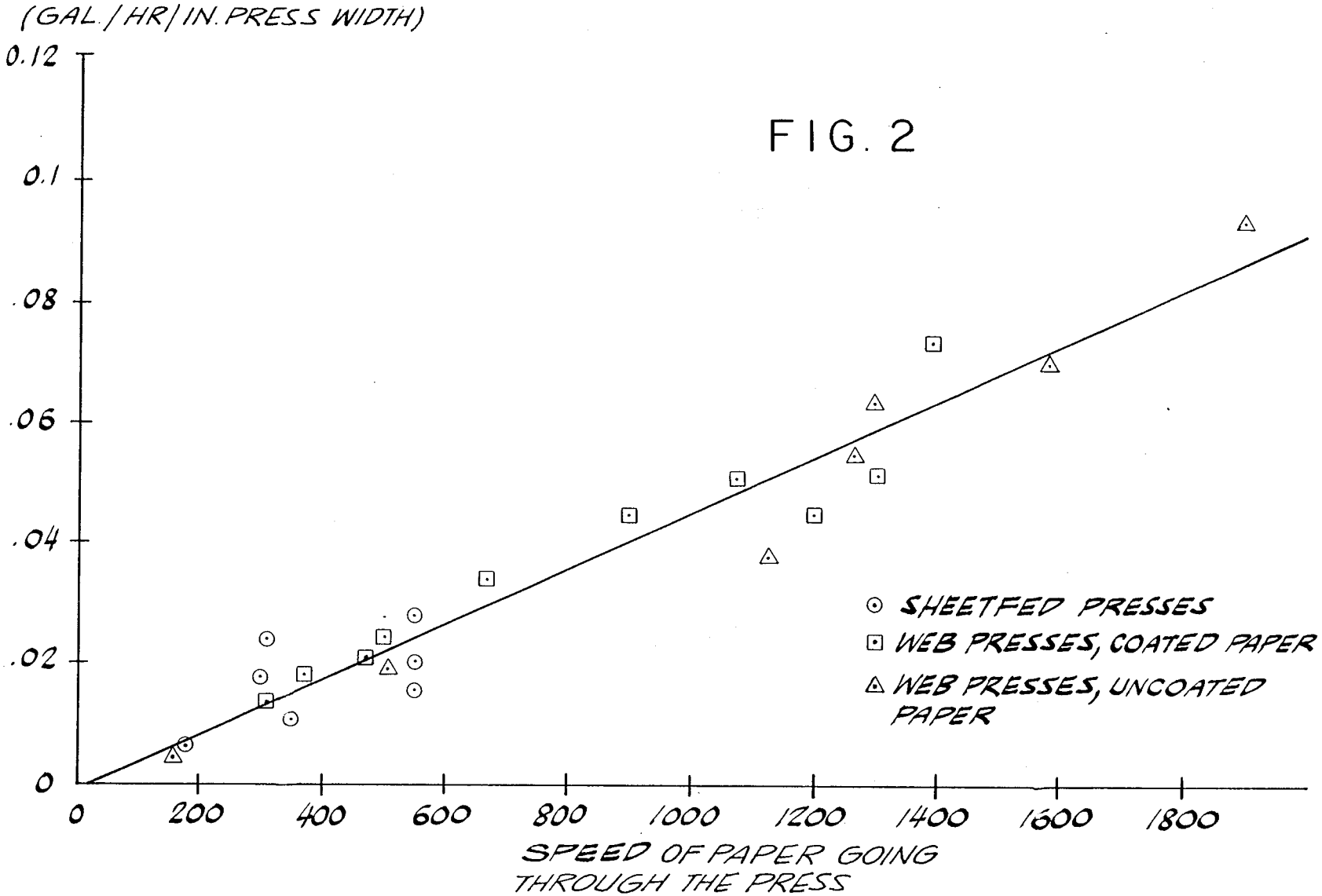
FIG. 2 shows results of Series I measurements. Details on presses are given in Table I.

In order to accomplish the foregoing objects and to overcome the inconsistenceies of an lack of knowledge in the prior art, a series of studies and measurements were made over a period of years. In the first series the actual steady state water consumption in a variety of presses was measured over a period of ten (10) years. Referring to Table I and FIG. 2, the actual steady state water consumption was measured under a variety of conditions. The conditions or variables were:

1. The type of printing press, i.e. sheet fed, heatset web, non-heatset web.
2. Size of press.
3. Type of Dampening System used on the press; e.g. Epic, Rolandmatic, Spray, Dahlgren, etc.
4. Type of Paper, i.e. coated and uncoated
5. Press speed in feet per minute.
6. Fountain solution alcohol content in percent.
7. Fountain solution temperature in degrees Fahrenheit The results of the measurements are shown in Figure 2 where water is plotted in gallons per hour per inch of press width against speed in feet per minute (the speed the paper goes through the press). Thus, FIG. 2 identifies the type of press as ⊙ sheet fed press, ⊡ web press - coated paper, and △ web press - uncoated paper.

The results of these measurements showed that there was a relatively constant water consumption over the wide range of printing variables shown, under steady state printing conditions. Specifically, the equivalent water film thickness (the thickness of an equivalent web of water, the width of the press travelling at press speed) had a mean value of 0.37 microns with a standard deviation of 0.09 microns.

A second series of measurements was run in which the number of variables were reduced In this series of measurements the width of the sheetfed press was constant, i.e. 25 inches, and the water feedrate was operated at the low end of the acceptable feed rate There were three variables in this test.

Figure 3:
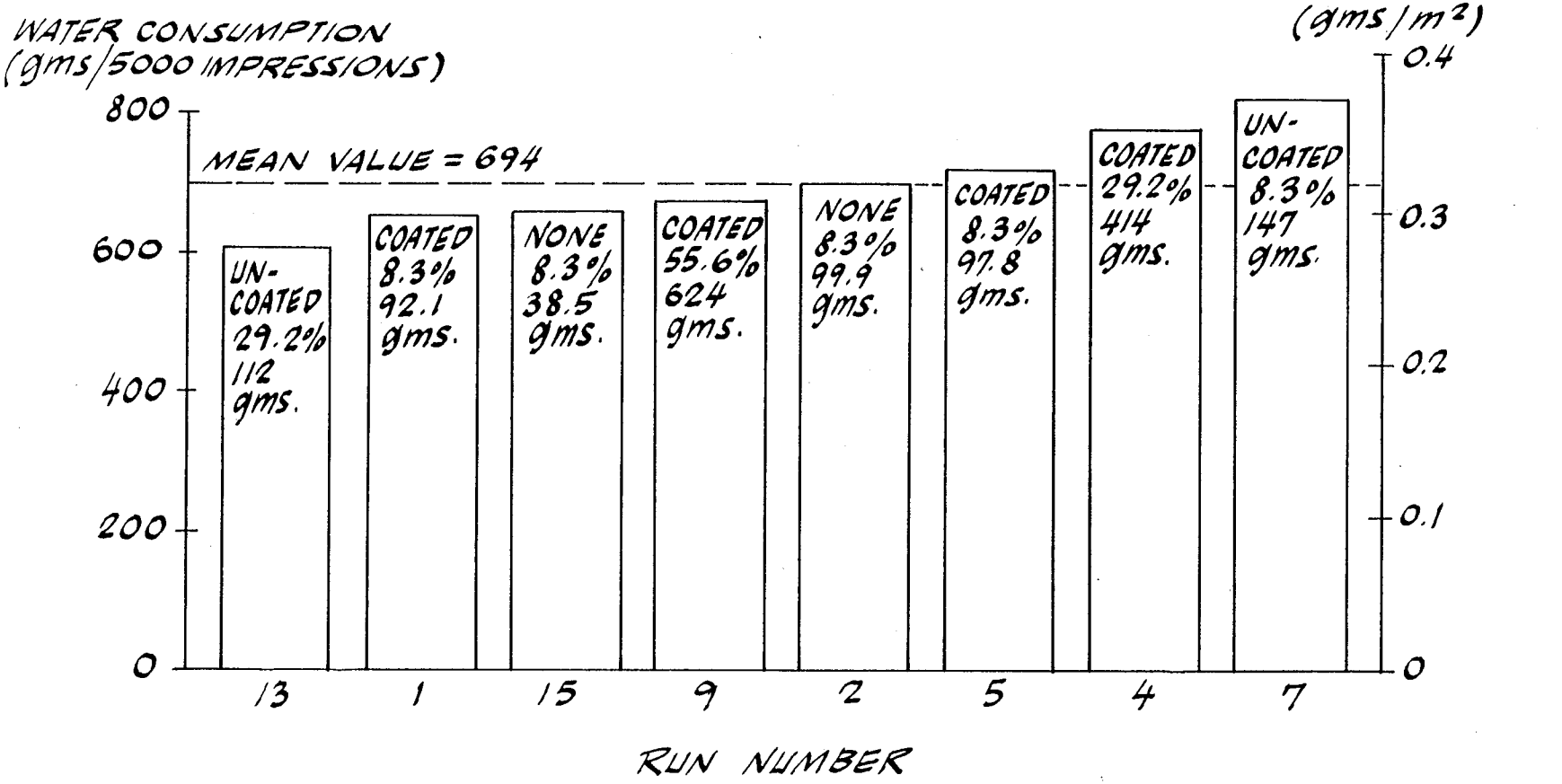
FIG. 3 is a bar chart comparing water consumption in eight different press runs in which only three parameters were varied: Type of Paper (coated, uncoated, none), Ink Coverage (percent of total area), and Ink Feed Rate (grams per 5000 impressions).

The first variable was the type of substrate used. The runs used coated paper, uncoated paper, and no paper at all. The second variable was the percent (%) of ink coverage, i.e. 8.3%, 29.2%, and 55.6%. The third variable was the ink consumption rate. The bar chart FIG. 3 shows the water consumption with the above three parameters varied. The ink was in grams per 5,000 impressions. As indicated by FIG. 3, these measurements reveal that the water consumption changes only slightly over the wide range of these variables. That is, the mean equivalent water film thickness was 0.32 microns with maximum deviations of plus and minus 0.05 microns.

Figure 4:
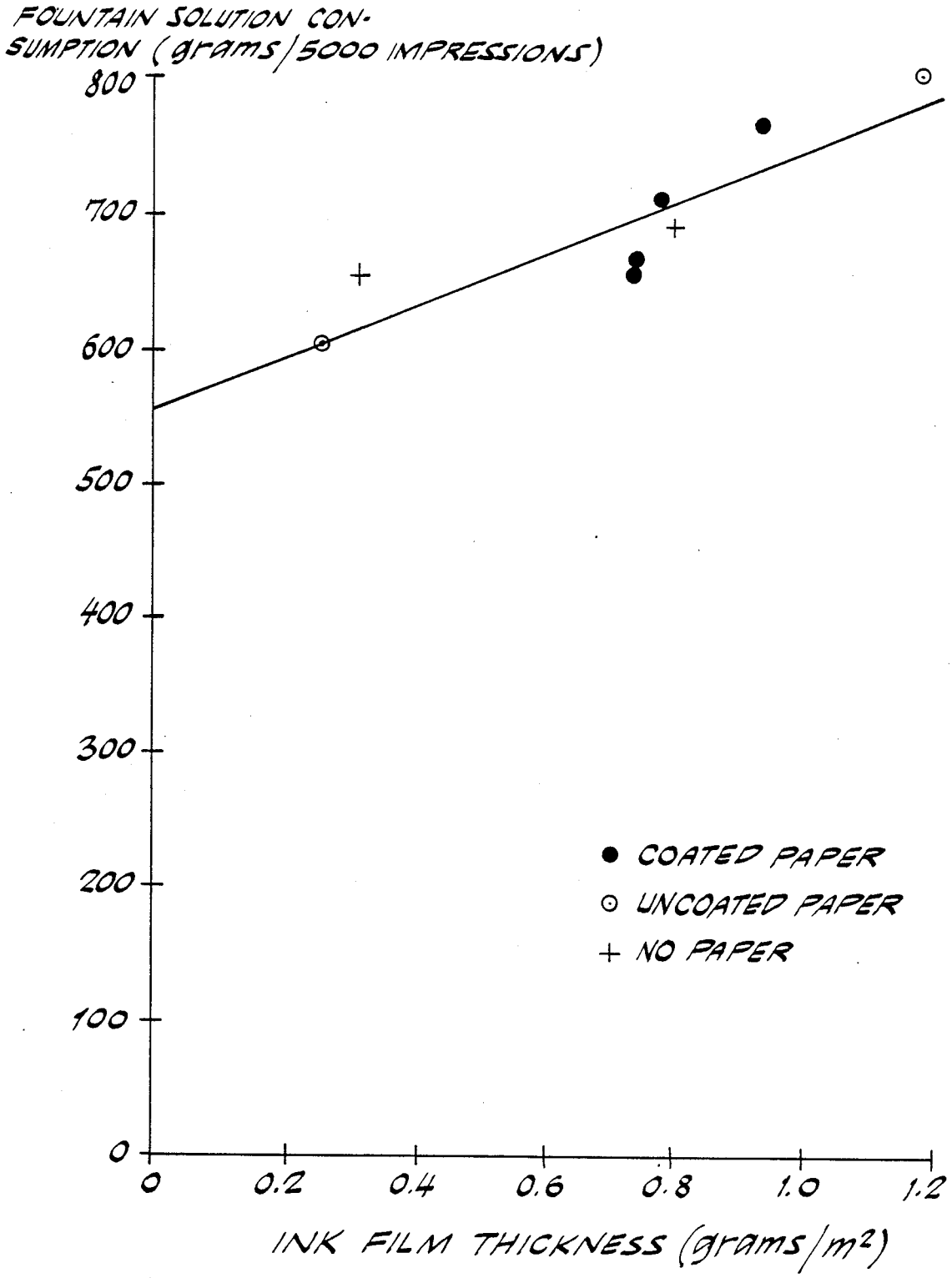
FIG. 4 is a graph showing correlation between water consumption and ink film thickness. Straight line fit of eight points covering conditions of coated, uncoated, and no paper has correlation coefficient of 0.886.

FIG. 4 shows the relationship of another set of data. This figure is a graph showing the correlation between water consumption and ink film thickness where coated paper is used ●, uncoated paper is used O, and no paper at all is used +.

The results in FIG. 4 show that there is a definite relationship between the film thickness of the ink applied to the paper and the optimum water feedrate. This discovery is of considerable importance while the printing press is in steady state operation. In addition, this discovery is of immense importance in designing a system which can cope with the transient requirements which occur during the startup of the printing press. In particular, this discovery has significance when prior to commencement of printing, the ink form rollers are not in contact with the plate cylinder (i.e. are off impression) Under these conditions, especially with high ink feedrate, the ink film thickness on the rollers closest to the plate will be thicker than it will be during steadystate printing. The discovery illustrated in FIG. 4 relates to the abnormally heavy ink film thickness on the inking rollers just prior to startup to the much higher water feedrate which is required at startup and thereby provides a method of determining the required transient water feedrate.

Figure 5:
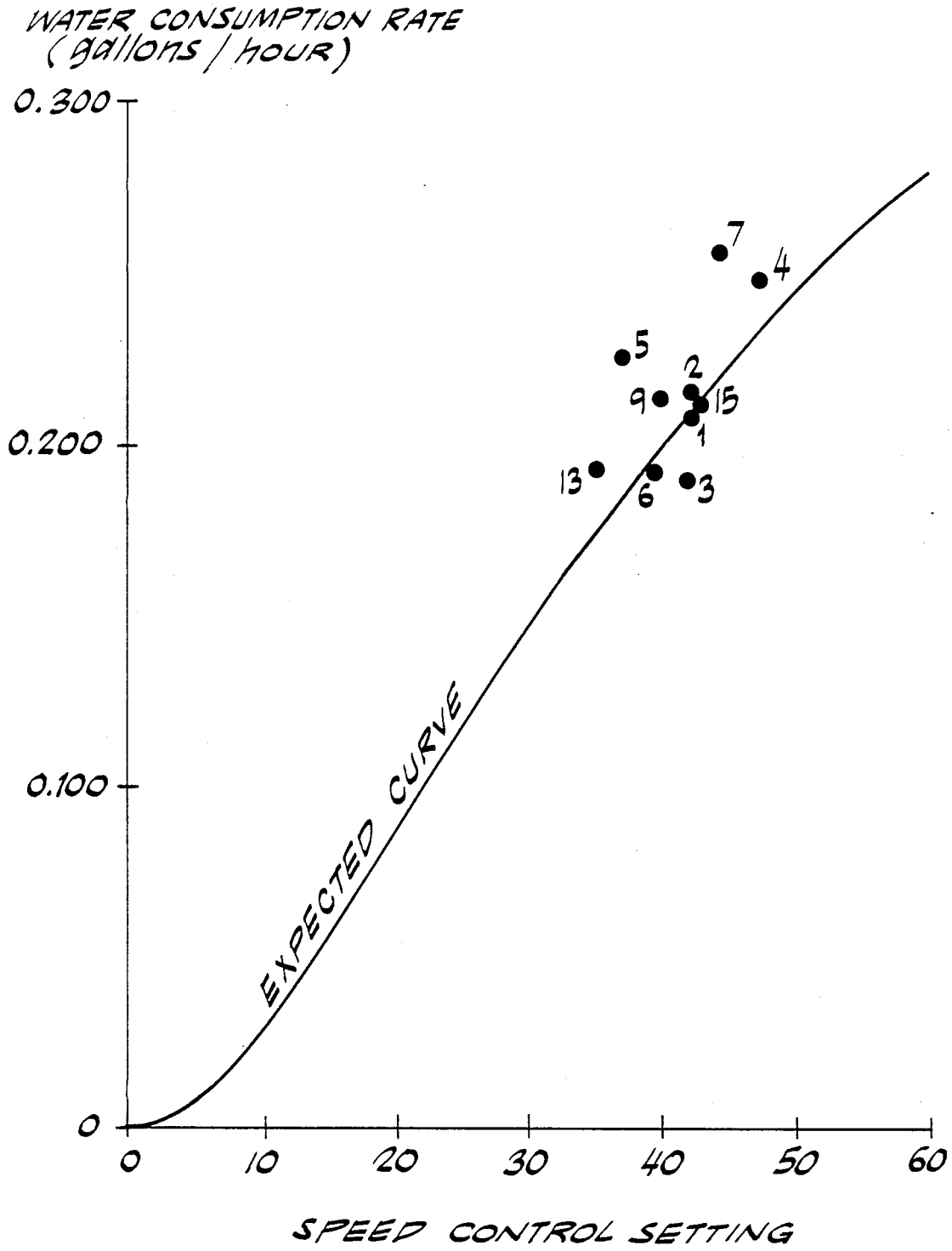
FIG. 5 is a graph showing poor correlation between speed control setting and water consumption rate for ten runs. Run numbers are indicated next to points. Expected curve is based on Zavodny's slip nip theory and is normalized to Run 1.

The graph of data from ten (10) runs in FIG. 5 shows that there is a very poor correlation between the dampener speed control setting and the water consumption rate.

As a result of the measurements made and discussed above as they relate to control and presetting of the water feedrate, the following conclusions can be drawn:

1. The ink film thickness on the ink form rollers or the immediately adjacent rollers determines the required water feedrate. Accordingly, the ink film thickness should be used to generate the demand signal or setpoint in a system to automatically regulate the water feedrate.

2. The fountain solution temperature and alcohol concentration will affect the water feedrate if allowed to vary as shown by entries 5, 6 and 7 of Table I.

3. In any control system in which the water feedrate or its effects are not directly measured, the dampening system controls must be redesigned to eliminate drift in the relationship between the control settings and the water feedrate. Variations in the dampening system could be caused by variations in roller settings, the metering nip size, or the roller hardness.

4. The problem of how to automatically satisfy the need to momentarily increase the water feedrate during startup can be solved by programming the demand signal for the water feedrate to follow the ink film thickness on an inking roller. Stated in another way, it has been found that water consumption is fairly consistent over a wide range of variables and that the only printing variables which have a modest effect on it are ink film thickness and temperature and alcohol content of the fountain solution. It has also been found that contrary to some prior art, the type of paper used, e.g. coated or uncoated, is not as important nor is the precentage of ink coverage.

TABLE I

Summary of Measurements of Fountain Solution Consumption Rate

| Entry Number | Press Type | Press Size | Type of Dampening System | Type of Paper | Press Speed (iph) | Press Speed (fpm) | Fountain Solution Percent Alcohol | Fountain Solution Temperature (°F.) | Size of Form (inches) | Fountain Solution Consumption Rate (gal/hr/pan) | Fountain Solution Consumption Rate (microns) |
|---|---|---|---|---|---|---|---|---|---|---|---|
| 1 | Sheetfed | 20 | Epic Delta | Coated | 5,700 | 176 | 25 | 65 | 20 × 14 | 0.124 | 0.29 |
| 2 | | 40 | Rolandmatic | Coated | 6,200 | 301 | 25 | 60–66 | 36 × 24 | 0.6–0.83 | 0.45–0.62 |
| 3 | | 40 | Spray, Weco | Coated | 6,700 | 310 | 28 | 61 | 40 × 28 | 0.95 | 0.62 |
| 4 | | 49 | Dahlgren | Coated | 5,000 | 350 | 28 | ? | 48 × 36 | 0.5 | 0.26 |
| 5 | | 77 | Dahlgren | Coated | 6,000 | 550 | 28 | 60 | 61⅞ × 50½ | 2.15 | 0.41 |
| 6 | | 77 | Dahlgren | Coated | 6,000 | 550 | 15 | 40 | 61⅞ × 50½ | 1.55 | 0.30 |
| 7 | | 77 | Dahlgren | Coated | 6,000 | 550 | 28 | 40 | 61⅞ × 50½ | 1.2 | 0.23 |
| 8 | Heatset Web | 26 | Duotrol | Coated | 12,600 | 310 | 25 | 65–70 | 17½ × 17¾ | 0.35 | 0.35 |
| 9 | | 30 | Dahlgren | Coated | 40,000 | 1,200 | 25 | ? | 28½ × 21 | 1.35 | 0.31 |
| 10 | | 38 | Ductor | Coated | 12,000 | 376 | Zero | Ambient | 38 × 22 9/16 | 0.54–0.84 | 0.31–0.48 |
| 11 | | 38 | Ductor | Coated | 15,000 | 470 | Zero | Ambient | 38 × 22 9/16 | 0.68–0.9 | 0.31–0.41 |
| 12 | | 38 | Ductor | Coated | 16,000 | 501 | Zero | Ambient | 38 × 22 9/16 | 0.72–1.12 | 0.31–0.48 |
| 13 | | 38 | Duotrol | Coated | 41,200 | 1,302 | 25 | | 35 × 22¾ | 1.94 | 0.32 |
| 14 | | 38 | Duotrol | Coated | 21,000 | 664 | 25 | | 35 × 22¾ | 1.28 | 0.41 |
| 15 | | 38 | Duotrol | Coated | 28,400 | 900 | 28 | 55 | 35 3/16 × 22¾ | 1.65–1.75 | 0.39–0.42 |
| 16 | | 38 | Brush | Coated | 34,000 | 1,074 | Zero | ? | 33 × 22¾ | 1.85–2.0 | 0.37–0.40 |
| 17 | | 38 | Brush | Coated | 44,000 | 1,393 | Zero | Ambient | 35 × 22 13/16 | 2.81 | 0.43 |
| 18 | Non-Heatset Web | 35 | Continuous Feed-Goss | Uncoated | 5,000 | 157 | Zero | Ambient | 30 × 22 9/16 | 0.16 | 0.24 |
| 19 | | 35 | Continuous Feed-Goss | Uncoated | 36,000 | 1,128 | Zero | 78 | 29 × 2 11/16 | 1.26–1.36 | 0.26–0.28 |
| 20 | | 60 | Flapper-TKS | Uncoated | 16,000 | 506 | Zero | Ambient | 60 × 22¾ | 1.15 | 0.31 |
| 21 | | 60 | Flapper-TKS | Uncoated | 40,000 | 1,264 | Zero | Ambient | 60 × 22¾ | 3.29 | 0.35 |
| 22 | | 68 | Brush | Uncoated | 40–42,000 | 1,264–1,327 | Zero | Ambient | 60 × 22¾ | 4.3 | 0.39–0.41 |
| 23 | | 68 | Spray,Smith | Uncoated | 50,000 | 1,580 | Zero | Ambient | 55 × 21¾ | 4.8 | 0.36 |
| 24 | | 68 | Brush | Uncoated | 60,000 | 1,896 | Zero | Ambient | 60 × 22¾ | 6–6¾ | 0.38–0.43 |

BRIEF DESCRIPTION OF THE INVENTION

Briefly described, the present invention relates to a means and method for controlling the water feedrate on lithographic presses The process automatically adjusts the feedrate under all printing conditions and includes the steps regulating the temperature of the fountain solution so that it is constant and regulating the alcohol content of the fountain solution so that it remains constant The invention senses or monitors the thickness of the ink film on an inking roller close to the plate which is used to determine a demand signal or setpoint to regulate the rate of flow of the water. The invention further provides for a momentary increase in the water feedrate at startup due to the momentary increase in thickness of the ink film on the ink rolls at start up.

The invention consists of the novel parts, constructions steps, procedures and improvements shown and described.

DETAILED DESCRIPTION OF THE INVENTION

Figure 6:
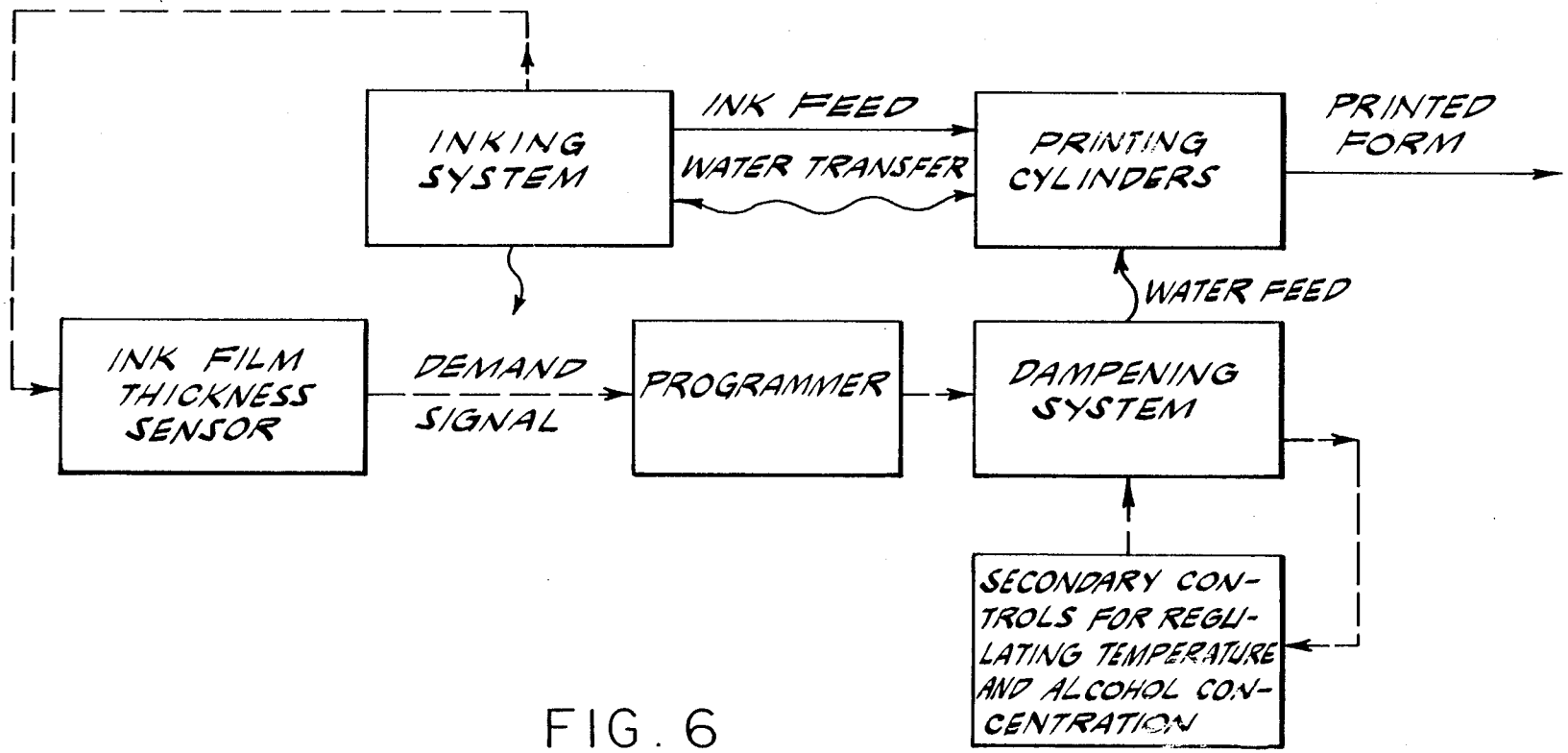
FIG. 6 is a block diagram of preferred method for automatically controlling water feedrate to plate.

Referring to the drawings and particularly FIG. 6, there is illustrated a block diagram of a preferred emodiment of the present invention. For control purposes and ease of illustration, the printing press is illustrated as consisting of three (3) components namely, the inking system which feeds ink to the printing cylinder, the dampening system which feeds water to the printing cylinder and the printing cylinders from which the printed forms are discharged as shown. The dampening system is designed and constructed so that there is a fixed relationship between the water feedrate to the plate and the input demand signal, i.e. with no drift. The process includes the steps of regulating the fountain solution so that the temperature is maintained constant. In addition, the alcohol concentration is regulated so that the alcohol concentration in the fountain solution remains constant. In this way the process controls other variables which might otherwise have an effect on the water feedrate.

In accordance with this invention, means or a step is provided for controlling the water feedrate by measuring the ink film thickness on an inking system roller and controlling the ink feed rate by the ink film thickness. As embodied, this includes the step of sensing the ink film by measuring the ink film thickness on an inking system roller. This step can be accomplished by sensors which are conventional in the art and simply measure the ink film thickness on one of the inking rollers close to the plate cylinder. The ink film thickness sensor sends a demand signal proportional to the ink film thickness to a programmer or controller. The purpose is to produce a relationship between the water fountain solution consumption and the ink film thickness as illustrated in the graph of FIG. 4. In this way, the water feedrate is proportional to the ink film thickness.

The process of this invention automatically adjusts the water feedrate under all conditions without human intervention. This method or process makes it unnecessary to sense the water feedrate either directly on the plate cylinder or on the printed form.

Figure 7:
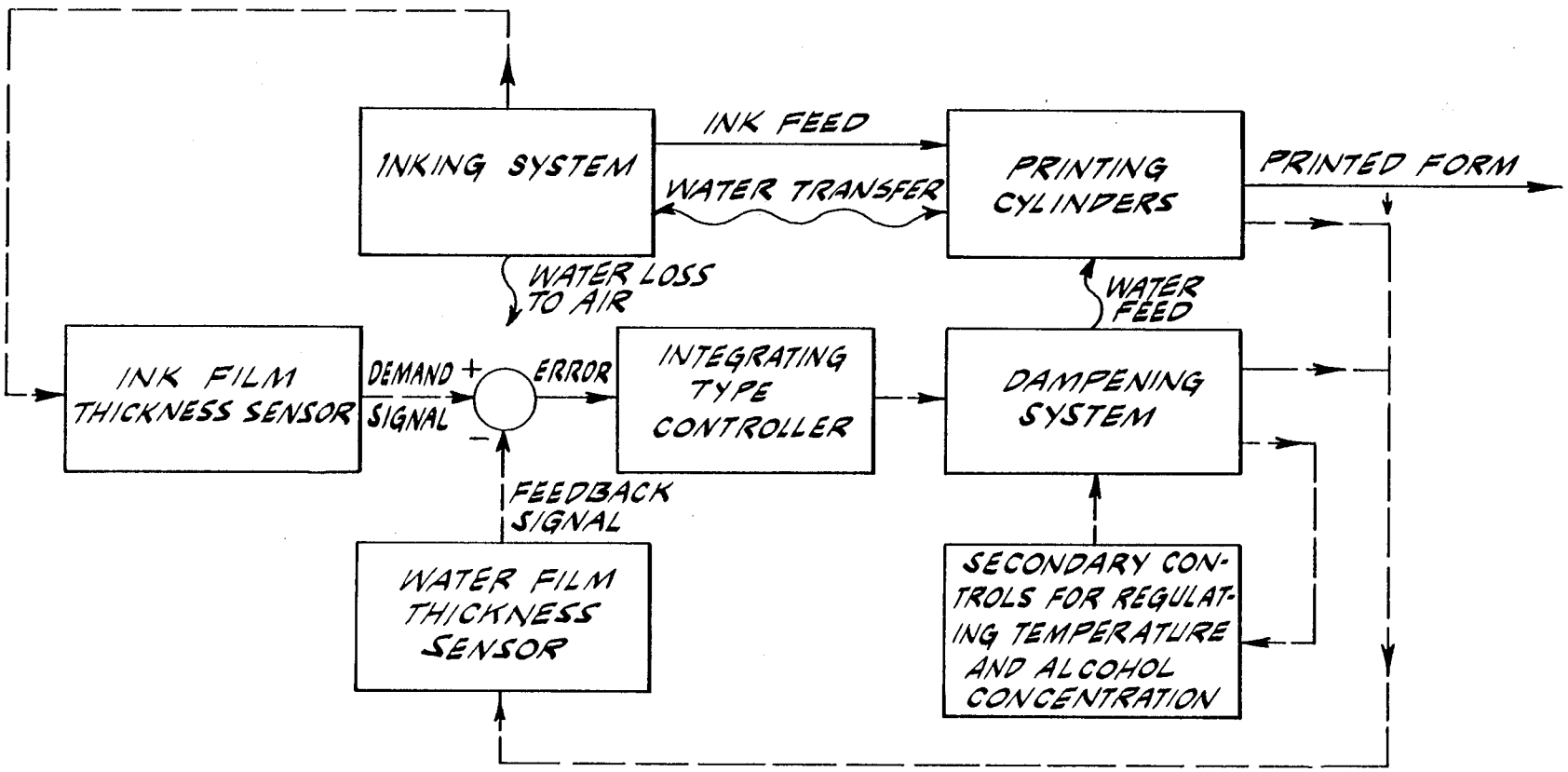
FIG. 7 is a block diagram of alternate method for automatically controlling water feedrate to plate.

Another embodiment of the invention is illustrated in FIG. 7. This embodiment is desirable where for one reason or another it is not possible to eliminate the dampening system drift. In this FIG. 7 the printing press consists of three (3) components, i.e. the printing cylinders, the inking system and the dampening system. The inking system feeds ink to the printing cylinder which in turn discharges the printed forms. In this embodiment, as in the preferred embodiment, there is a conventional ink film sensor for sensing the ink film thickness on an inking system roller. The ink film sensor sends a demand signal to an integrating type controller.

As is the case of the FIG. 6 embodiment, there are the steps of maintaing the temperature and the alcohol concentration constant so as to eliminate these possible variables as affecting the water feedrate.

In this embodiment of the invention, however, the dampening system drift is compensated for by using a closed loop system in which the water film thickness is sensed by a water film thickness sensor to provide a feedback signal The water film thickness sensor is conventionally available in the art and can sense the water film thickness on either the plate cylinder or a dampening system roller. As can be seen, the water film thickness sensor sends a feedback signal to the integrating type controller to determine the water feedrate.

What is claimed is:

1. A process for automatically controlling the water feedrate to a lithographic press including plate and blanket cylinders, an inking system having ink form rollers for delivering ink to the plate cylinder and a dampening system having dampening rollers for delivering dampening fluid to the plate cylinder comprising the steps of:
   a. regulating the temperature of the fountain solution,
   b. regulating the alcohol concentration of the fountain solution,
   c. sensing the ink film thickness on one of the ink form rollers,
   d. feeding dampening water to the printing plate at a rate proportional to the ink film thickness on the ink form rollers.

2. A process as defined in claim 1 wherein the feed rate of dampening water is momentarily increased at startup.

3. A process as defined in claim 2 wherein there is a step of measuring the water film thickness and using that measurement in conjunction with the ink film thickness to form an error signal for controlling the water feedrate.

4. A process for automatically controlling the water feedrate to a lithographic printing press including plate cylinder, an ink system having ink form rollers and a dampening system having dampening rollers comprising the steps of:
   a. regulating the temperature of the fountain solution,
   b. regulating the alcohol concentration of the fountain solution,
   c. maintaining the dampening system variables constant,
   d. sensing the ink film thickness on one of the ink form rollers,
   e. feeding dampening water to the printing plate at a rate dependent upon the ink film thickness.

* * * * *